US005385318A

United States Patent [19]

Rizzuto

[11] Patent Number: 5,385,318

[45] Date of Patent: Jan. 31, 1995

[54] APPARATUS FOR DISPENSING SHEET MATERIAL

[75] Inventor: Jack A. Rizzuto, Antioch, Calif.

[73] Assignee: James River Paper Company, Inc., Richmond, Va.

[21] Appl. No.: 92,443

[22] Filed: Jul. 14, 1993

[51] Int. Cl.[6] ..... B65H 16/04

[52] U.S. Cl. ..... 242/597.8

[58] Field of Search ..... 242/55.2, 55.53, 597.8; 206/389, 397

[56] References Cited

U.S. PATENT DOCUMENTS

| | | | |
|---|---|---|---|
| D. 187,853 | 5/1960 | Smith . | |
| D. 211,258 | 6/1968 | Shrier . | |
| 1,297,110 | 3/1919 | Davis . | |
| 2,152,426 | 3/1939 | Wilson | 242/55.2 |
| 2,422,749 | 6/1947 | Rougas . | |
| 3,085,760 | 4/1963 | Belsky . | |
| 3,428,267 | 2/1969 | Briles . | |
| 4,179,078 | 12/1979 | Mansfield . | |
| 4,762,288 | 8/1988 | Eckels . | |
| 4,913,364 | 4/1990 | Hu . | |

FOREIGN PATENT DOCUMENTS

| | | | |
|---|---|---|---|
| 851161 | 10/1960 | United Kingdom | 242/55.2 |
| 2210021 | 6/1989 | United Kingdom | 242/55.2 |

*Primary Examiner*—Daniel P. Stodola
*Assistant Examiner*—John P. Darling
*Attorney, Agent, or Firm*—Thomas R. Lampe

[57] ABSTRACT

Apparatus for dispensing sheet material from a roll of sheet material includes a base member, a mandrel connected to the base member, and a shield movable relative to the base member between first and second locations. When the shield is in one of the locations it will prevent end-wise movement of the roll on the mandrel and removal of the roll. A lock prevents movement of the shield until the roll is at least partially depleted during dispensing.

8 Claims, 3 Drawing Sheets

APPARATUS FOR DISPENSING SHEET MATERIAL

TECHNICAL FIELD

This invention relates to apparatus for dispensing sheet material, such as paper tissue, from a roll of sheet material. The apparatus incorporates a shield which protects the roll of sheet material from dust and dirt and also prevents removal of the roll from the dispenser apparatus until the roll has been substantially depleted.

BACKGROUND ART

Many dispenser arrangements for dispensing toilet tissue, paper toweling and the like are known in the art. A search directed to the present invention located the following patents: U.S. Pat. No. 3,085,760, issued Apr. 26, 1963, U.S. Pat. No. 4,179,078, issued Dec. 18, 1979, U.S. Pat. No. 2,422,749, issued Jun. 24, 1947, U.S. Pat. No. Des. 211,258, issued Jun. 4, 1968, U.S. Pat. No. 4,913,364, issued Apr. 3, 1990, U.S. Pat. No. 4,762,288, issued Aug. 9, 1988, U.S. Pat. No. 3,428,267, issued Feb. 18, 1969, U.S. Pat. No. 1,297,110, issued Mar. 11, 1919, and U.S. Pat. No. Des. 187,853, issued May 10, 1960. The devices and mechanisms disclosed in these patents are believed to be representative of the prior art.

DISCLOSURE OF INVENTION

The present invention relates to a dispenser for roll products such as toilet tissue and paper toweling which is characterized by its simplicity and relatively low cost. The apparatus of the present invention not only protects the roll product being dispensed from contamination by dirt or dust, it incorporates structure which prevents removal of a roll until the size of the roll has been substantially diminished during the normal course of dispensing. This feature is particularly important when the dispensing apparatus is located in an area readily accessible to the public, such as in a public washroom.

The apparatus of the present invention is for dispensing sheet material from a roll of sheet material, the roll of sheet material having a central aperture extending from one end of the roll to an opposed end along a longitudinal axis.

The apparatus includes a base member. A mandrel is connected to the base member and projects therefrom. The mandrel has a distal end spaced from the base member and the mandrel is insertable into the central aperture of a roll of sheet material to rotatably support the roll of sheet material and permit unwinding of the roll upon application of outside forces to the roll.

Shield means is movably mounted relative to the base member and selectively movable between a first location wherein the shield means covers at least a portion of the roll supported by the mandrel and restricts end-wise movement of the roll on the mandrel in the direction of the longitudinal axis thereof to maintain the roll of sheet material on the mandrel and a second location wherein the shield means will not restrict end-wise movement of the roll on the mandrel.

Lock means is operatively associated with the shield means to lock the shield means at the first location.

Manually operable actuator means is operatively associated with the lock means to unlock the lock means and allow movement of the shield means to the second location. The actuator means is blocked from manual access until a roll of sheet material on the mandrel has been at least partially depleted.

The shield means includes a cover element and a support element attached to the cover element. The support element is mounted for slidable engagement with the base member.

The cover element includes a cover top wall and a cover side wall. The cover side wall is attached to and dependent from the cover top wall and is of a size and configuration to be closely adjacent to and in at least partial registration with the mandrel distal end when the shield means is at said first location.

Other features, advantages, and objects of the present invention will become apparent with reference to the following description and accompanying drawings.

BEST MODE FOR CARRYING OUT THE INVENTION

Figure 1:
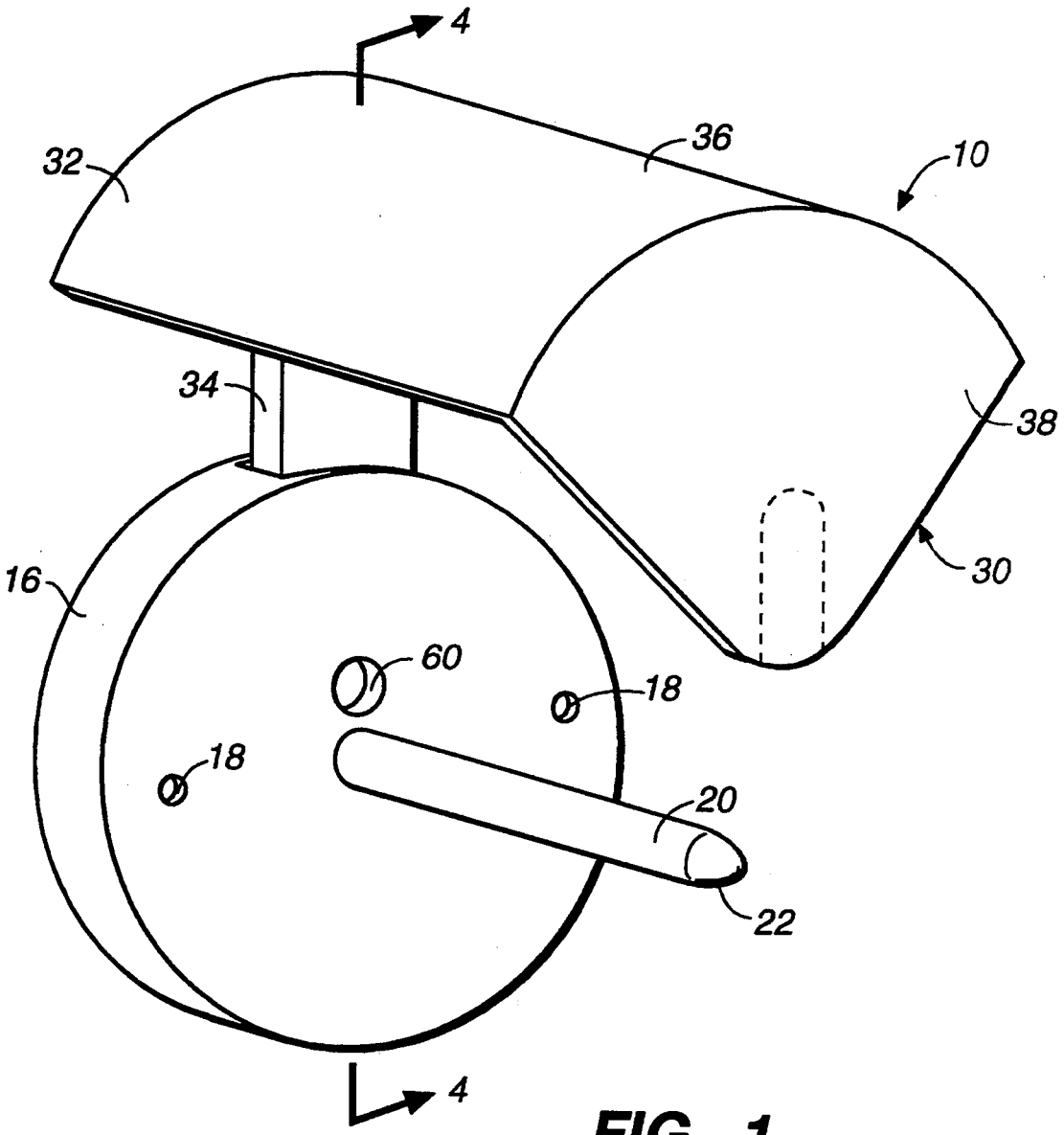
FIG. 1 is a frontal, perspective view illustrating apparatus constructed in accordance with the present invention showing structural components thereof in the relative positions assumed thereby prior to loading of a roll of sheet material into position on the apparatus.

Referring now to the drawings, apparatus constructed in accordance with the teachings of the present invention is designated generally by reference numeral 10. For purposes of illustration, apparatus 10 is used to dispense toilet tissue 12 from a roll 14 thereof; however, it is to be understood that the principles of the present invention may be utilized to dispense other types of sheet material. The apparatus may be constructed of any suitable material such as metal or plastic.

Apparatus 10 includes a base member 16. In the arrangement illustrated, base member 16 has two holes 18 therein which may accommodate screws or other mechanical fasteners (not shown) to secure the base member to a wall or other mounting surface.

A mandrel 20 projects from the base member 16. The mandrel has a distal end 22 spaced from the base member. The mandrel is inserted into the central aperture of roll 14. As is conventional, the central aperture extends from one end of the roll to an opposed end along a longitudinal axis. Since such feature is common to rolls such as tissue rolls, both coreless and with cores, it has not been illustrated.

The mandrel 20 is insertable into the central aperture of the roll to rotatably support the roll and permit unwinding thereof upon application of outside forces to the roll. These forces are commonly applied manually by pulling the end-most sheet or sheets of the tissue.

Figure 2:
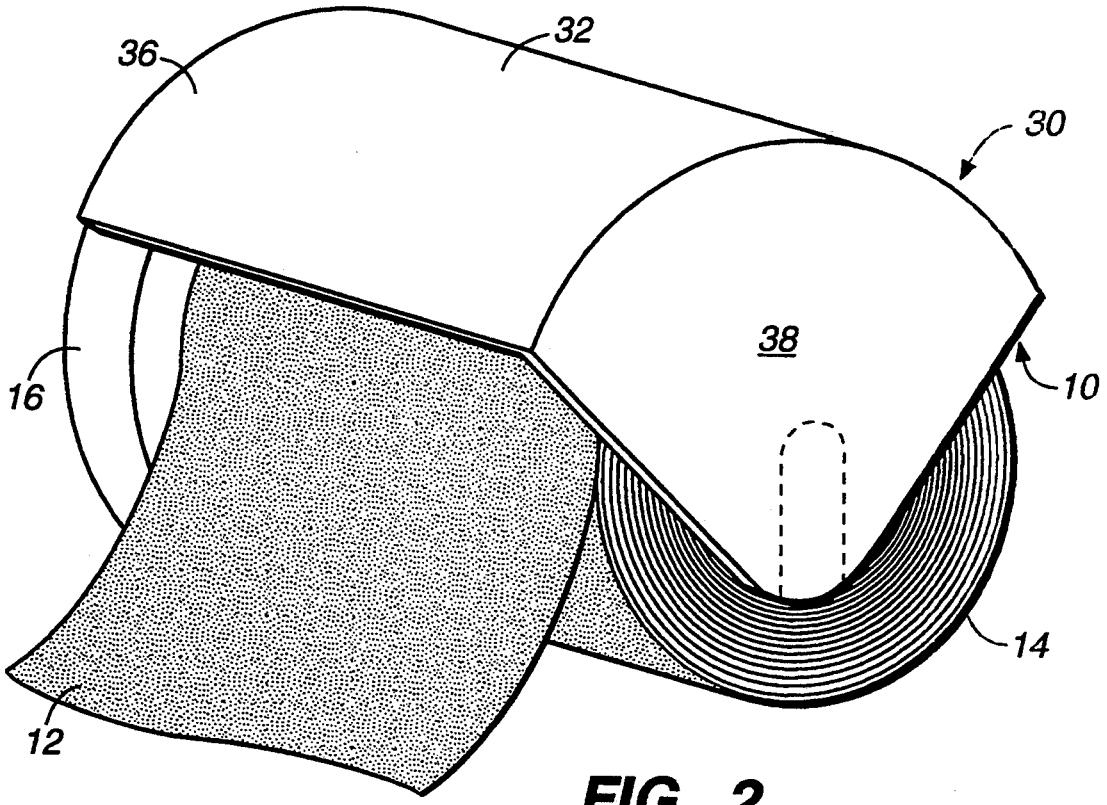
FIG. 2 is a view similar to FIG. 1 but illustrating the condition of the apparatus after a roll of sheet material has been installed and the structural components of the apparatus cooperate to prevent end-wise removal of the roll.
Figure 3:
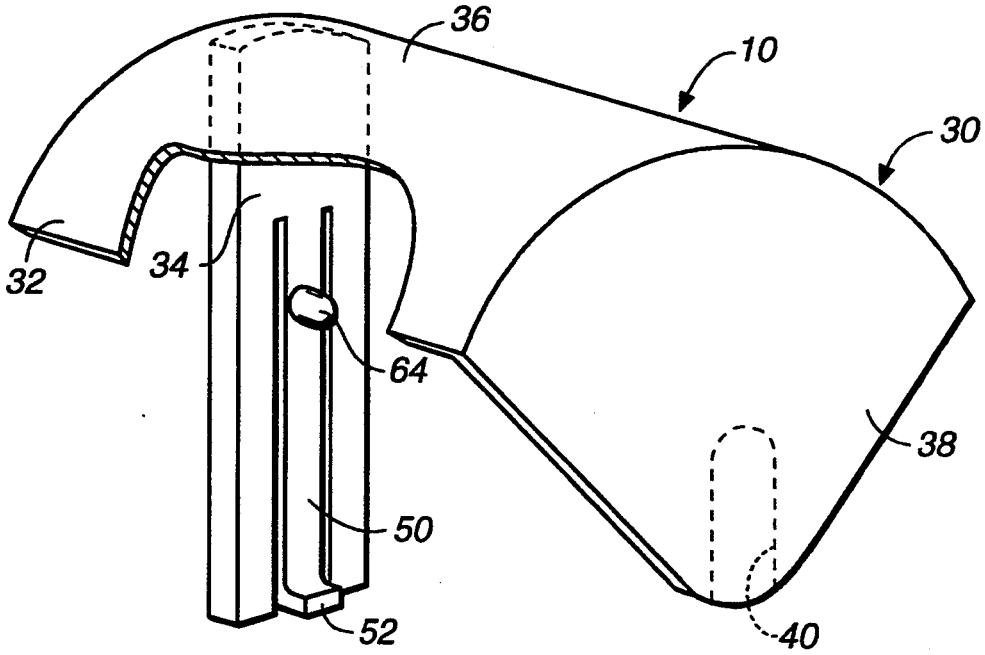
FIG. 3 is a perspective view of a shield utilized in the apparatus and selected associated structure.
Figure 4:
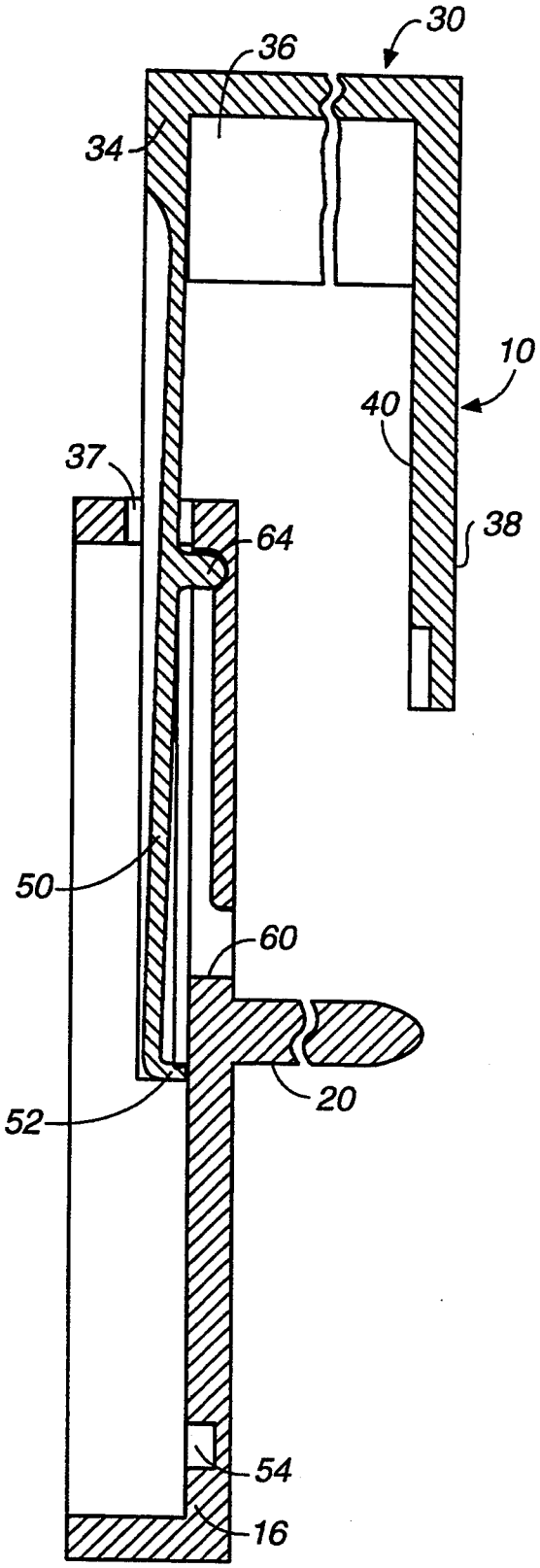
FIG. 4 is a cross-sectional view taken along the line 4—4 in FIG. 1.

A shield 30 is movably mounted relative to the base member and selectively movable between a first location shown in FIG. 2 to a second location shown in FIG. 1. When the shield 30 is in the location or position shown in FIG. 2, the shield covers a portion of the roll 14 and restricts end-wise movement of the roll on the mandrel in the direction of the longitudinal axis thereof to maintain the roll on the mandrel. That is, when the shield 30 is in the position shown in FIG. 2, the only way to deplete the roll is by the act of rotating the roll on the mandrel during the course of normal dispensing.

FIG. 1 shows the shield moved upwardly relative to the base member. When the shield is in this second location it will not restrict end-wise movement of a roll on the mandrel. A partially depleted roll may readily be removed from the mandrel by an attendant and replaced by a full roll.

The shield 30 includes a cover element 32 and a support element 34 attached to the cover element. The support element 34 is mounted in a slot 37 formed in the base member 16 for slidable engagement with the base member.

Figure 5:
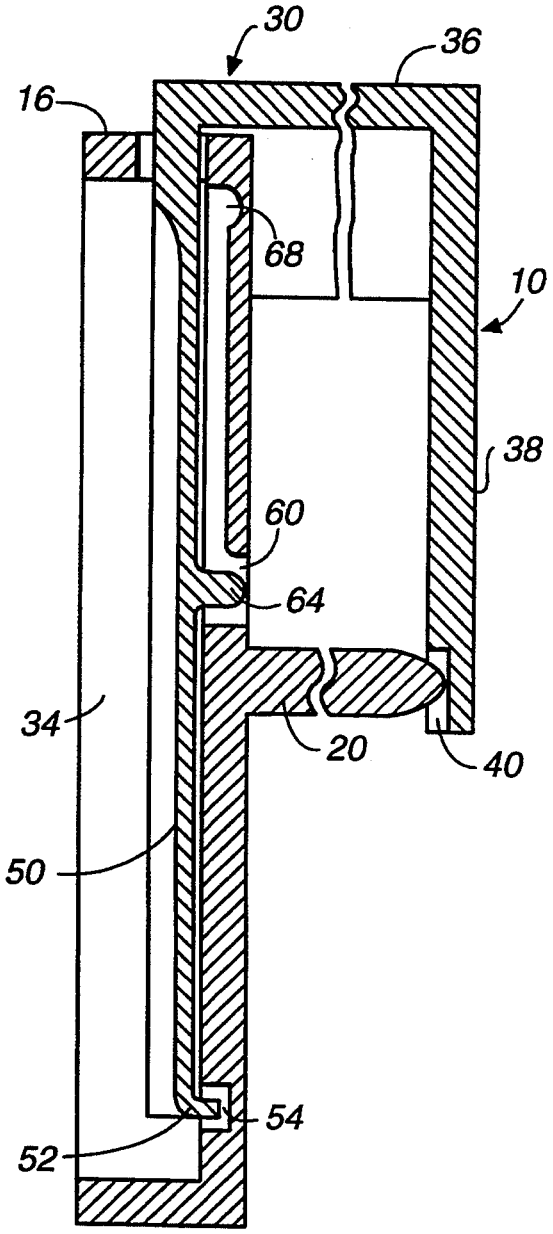
FIG. 5 is a view similar to FIG. 4 but illustrating the structural components of the apparatus in the relative positions assumed thereby as depicted in FIG. 2.

The cover element 32 includes a top wall 36 and a side wall 38, the side wall 38 being attached to and dependent from the cover top wall and of a size and configuration to be closely adjacent to and in at least partial registry with the mandrel distal end when the shield means is at the first location illustrated in FIGS. 2 and 5. The cover top wall has an inner surface of arcuate configuration generally corresponding to the outer configuration of a roll on the mandrel. The cover side wall 38 defines a recess 40 for receiving the mandrel distal end when the shield is at the first location.

Lock means is operatively associated with the shield to lock the shield at the first location. That is, after a roll 14 has been installed on the mandrel and the shield lowered to the position shown in FIG. 2, a lock arrangement will maintain the shield in such position. As will be seen below, the shield cannot be unlocked until the roll becomes substantially depleted.

Connected to support element 34 is a flexible biasing element or panel 50 which has a detent member 52 in the form of an outwardly turned lip at the bottom thereof. Detent member 52 is received by an indent 54 located near the bottom of base member 16 when the shield is in its first or lowered location or position as shown in FIGS. 2 and 5. Upward movement of the shield will be prevented due to engagement of the detent member 52 with the base member once the detent member or lip has entered the indent 54. The natural bias of the element 50 is toward the indent when the element 50 is bent or forced away from the indent.

Base member 16 defines an aperture 60 closely adjacent to mandrel 20. Aperture 60 will be covered by the roll 14 until the roll is substantially depleted during dispensing. Only after such substantial depletion can a consumer or attendant place his or her finger in the aperture 60.

An actuator element 64 in the form of a protrusion is connected to biasing element 50 at a location spaced from detent member 52. When the shield is in the lowered or first position shown in FIGS. 2 and 5, the actuator element 64 lines up with aperture 60. When the roll 14 has been sufficiently depleted due to dispensing, the user or attendant inserts his or her finger in aperture 60 and depresses actuator element 64. This will cause element or panel 52 to flex and detent member or lip 52 to be withdrawn from indent 54. A person may then move the shield upwardly by pulling it upwardly relative to the base member 16. This will allow removal of a stub roll, if any, as well as replacement thereof by a full roll.

In the arrangement illustrated, means is provided for retaining the shield at its second or elevated location to facilitate interchange of a roll on the mandrel. More particularly, when the shield has been raised to its second position or location, protrusion 64 will enter a second indent 68 formed in the base member. This frictional engagement between the base member and protrusion will be sufficient to retain the shield in the upper position; however, it is to be understood that application of a downward force on the shield will result in dislodgement of the protrusion 64 from the indent 68 so that the shield may move downwardly to its first or lowered position.

I claim:

1. Apparatus for dispensing sheet material from a roll of sheet material, said roll of sheet material having a central aperture extending from one end of the roll of sheet material to an opposed end along a longitudinal axis, said apparatus comprising, in combination:

a base member;

a mandrel connected to said base member and projecting therefrom, said mandrel having a distal end spaced from the base member, and said mandrel insertable into the central aperture a roll of sheet material along the longitudinal axis of the roll of sheet material to rotatably support the roll of sheet material and permit unwinding of the roll of sheet material about the longitudinal axis of the roll of sheet material upon application of outside forces to the roll of sheet material;

shield means movably mounted relative to said base member along a path of movement transverse to the longitudinal axis of the roll of sheet material and selectively movable between a first location wherein said shield means covers at least a portion of a roll of sheet material supported by the mandrel and restricts end-wise movement of said roll of sheet material on the mandrel in the direction of the longitudinal axis thereof to maintain the roll of sheet material on said mandrel and a second location wherein the shield means will not restrict end-wise movement of a roll of sheet material on the mandrel;

lock means operatively associated with said shield means to lock said shield means at said first location; and manually operable actuator means operatively associated with said lock means to unlock said lock means and allow movement of said shield means to said second location, said actuator means being blocked from manual access until a roll of sheet material on said mandrel has been at least partially depleted, said shield means including a cover element and a support element attached to said cover element, said support element being mounted for slidable engagement with said base member along said path of movement, and said cover element including a first cover wall extending in the direction of the longitudinal axis of the roll of sheet material and a second cover wall, said second cover wall being attached to said first cover wall and extending in a direction transverse to the longitudinal axis of the roll of sheet material, said second cover wall being of a size and configuration to be closely adjacent to and in at least partial registration with said mandrel distal end when said shield means is at said first location and said first cover wall being closer to the longitudinal axis of the roll when said shield means is in said first location than when said shield means is in said second location.

2. The apparatus according to claim 1 wherein said second cover wall has an inner surface of arcuate configuration generally corresponding to the outer configuration of a roll of sheet material on said mandrel.

3. The apparatus according to claim 1 wherein said second cover wall defines a recess for receiving the mandrel distal end when the shield means is at said first location.

4. The apparatus according to claim 1 wherein said base member defines an aperture closely adjacent to said mandrel, said aperture being covered by a roll of sheet material on said mandrel until at least partial depletion of said roll of sheet material, said manually operable actuator means including an actuator element in at least partial registry with said aperture when said shield means is at said first location.

5. The apparatus according to claim 4 wherein said lock means includes a detent member connected to said support element and movable relative to said support element and wherein said base member defines an indent accommodating said detent member to prevent relative movement between said shield means and said base member when said shield means is in said first location.

6. Apparatus for dispensing sheet material from a roll of sheet material, said roll of sheet material having a central aperture extending from one end of the roll of sheet material to an opposed end along a longitudinal axis, said apparatus comprising, in combination:

a base member;

a mandrel connected to said base member and projecting therefrom, said mandrel having a distal end spaced from the base member, and said mandrel insertable into the central aperture of a roll of sheet material to rotatably support the roll of sheet material and permit unwinding of the roll of sheet material upon application of outside forces to the roll of sheet material;

shield means movably mounted relative to said base member and selectively movable between a first location wherein said shield means covers at least a portion of a roll of sheet material supported by the mandrel and restricts end-wise movement of said roll of sheet material on the mandrel in the direction of the longitudinal axis thereof to maintain the roll of sheet material on said mandrel and a second location wherein the shield means will not restrict end-wise movement of a roll of sheet material on the mandrel;

lock means operatively associated with said shield means to lock said shield means at said first location;

manually operable actuator means operatively associated with said lock means to unlock said lock means and allow movement of said shield means to said second location, said actuator means being blocked from manual access until a roll of sheet material on said mandrel has been at least partially depleted; and retention means for selectively retaining said shield means at said second location to facilitate installation of a roll of sheet material on said mandrel.

7. Apparatus for dispensing sheet material from a roll of sheet material, said roll of sheet material having a central aperture extending from one end of the roll of sheet material to an opposed end along a longitudinal axis, said apparatus comprising, in combination:

a base member;

a mandrel connected to said base member and projecting therefrom, said mandrel having a distal end spaced from the base member, and said mandrel insertable into the central aperture of a roll of sheet material to rotatably support the roll of sheet material and permit unwinding of the roll of sheet material upon application of outside forces to the roll of sheet material;

shield means movably mounted relative to said base member and selectively movable between a first location wherein said shield means covers at least a portion of a roll of sheet material supported by the mandrel and restricts end-wise movement of said roll of sheet material on the mandrel in the direction of the longitudinal axis thereof to maintain the roll of sheet material on said mandrel and a second location wherein the shield means will not restrict end-wise movement of a roll of sheet material on the mandrel;

lock means operatively associated with said shield means to lock said shield means at said first location; and manually operable actuator means operatively associated with said lock means to unlock said lock means and allow movement of said shield means to said second location, said actuator means being blocked from manual access until a roll of sheet material on said mandrel has been at least partially depleted, said base member defining an aperture closely adjacent to said mandrel, said aperture being covered by a roll of sheet material on said mandrel until at least partial depletion of said roll of sheet material, said manually operable actuator means including an actuator element in at least partial registry with said aperture when said shield means is at said first location, said lock means including a detent member connected to said support element and movable relative to said support element, and said base member defining an indent accommodating said detent member to prevent relative movement between said shield means and said base member when said shield means is in said first location, said detent member being attached to a biasing element connected to said support element which resists movement of said detent member from said indent when said detent member is accommodated by said indent.

8. The apparatus according to claim 7 wherein said actuator element is connected to said biasing element at a location spaced from said detent member.

* * * * *